US006223914B1

(12) United States Patent
Snell

(10) Patent No.: US 6,223,914 B1
(45) Date of Patent: May 1, 2001

(54) OVER THE DOOR BRACKETS

(75) Inventor: Russell Benton Snell, Shaker Heights, OH (US)

(73) Assignee: InterDesign, Solon, OH (US)

( * ) Notice: Subject to any disclaimer, the term of this patent is extended or adjusted under 35 U.S.C. 154(b) by 0 days.

(21) Appl. No.: 09/396,028

(22) Filed: Sep. 15, 1999

(51) Int. Cl.[7] ..... A47B 96/06; A47F 5/00
(52) U.S. Cl. ..... 211/119.04; 211/117; 248/317
(58) Field of Search ..... 211/119.004, 113, 211/117–119, 85.3, 87.01, 86.01; 248/214–215, 304, 317, 339, 340

(56) References Cited

U.S. PATENT DOCUMENTS

| | | | | |
|---|---|---|---|---|
| 1,090,374 | * | 3/1914 | Barnhart | 211/113 |
| 1,189,677 | | 7/1916 | Farlese . | |
| 1,354,811 | * | 10/1920 | Faistenhammer . | |
| 1,596,572 | * | 8/1926 | Bates | 211/113 |
| 2,018,836 | * | 10/1935 | Clemence . | |
| 2,270,796 | | 1/1942 | Hauser . | |
| 2,447,128 | * | 8/1948 | Logan | 211/119 |
| 2,508,527 | | 5/1950 | Martin et al. . | |
| 2,633,998 | | 4/1953 | Derman . | |
| 2,732,162 | * | 1/1956 | McKinley . | |
| 2,769,552 | * | 11/1956 | Seidman | 211/113 |
| 2,925,916 | * | 2/1960 | Pollock | 248/214 |
| 2,972,419 | | 2/1961 | Zelen et al. . | |
| 3,175,696 | * | 3/1965 | Milbourne | 211/119.004 |
| 3,918,670 | * | 11/1975 | Doherty | 248/214 |
| 4,123,024 | * | 10/1978 | Levy | 248/214 |
| 4,846,430 | | 7/1989 | Ke . | |
| 4,860,984 | * | 8/1989 | Alperson | 248/215 |
| 4,901,871 | | 2/1990 | Ohm et al. . | |
| 4,957,259 | * | 9/1990 | Wolf, Jr. | 248/304 |
| 5,014,948 | | 5/1991 | Asaro et al. . | |
| 5,620,159 | * | 4/1997 | Tacvk | 248/214 |
| 5,695,073 | * | 12/1997 | Klein et al. | 211/118 |
| 5,810,304 | | 9/1998 | Lehrman . | |
| 5,875,902 | * | 3/1999 | Emery et al. | 211/119 |
| 5,894,940 | | 4/1999 | Gusdorf et al. . | |
| 5,947,433 | * | 9/1999 | Klein | 248/214 |

* cited by examiner

*Primary Examiner*—Daniel P. Stodola
*Assistant Examiner*—Jennifer E. Novosad
(74) *Attorney, Agent, or Firm*—D. Peter Hochberg; Katherine R. Vieyra; William H. Holt

(57) ABSTRACT

An over the door bracket for being hung over a door having a top portion, a first side and a second side. The bracket includes a door connecting member for being placed on top of the door, a generally tubular member extending from the door connecting member, and a clothing support attaching member for securing a clothing support to the bracket. The generally tubular member has a frontward facing surface and a rearward facing surface. A first connecting end is connected to the door connecting member and a second connecting end is disposed at the opposite end of the first connecting end. The frontward facing surface is adjacent to the second side of the door when the door connecting member is placed on top of the door.

19 Claims, 2 Drawing Sheets

OVER THE DOOR BRACKETS

BACKGROUND OF THE INVENTION

1. Field of the Invention

This invention relates to clothing brackets, and in particular to an over the door bracket system for hanging clothes and the like.

2. Description of the Prior Art

Over the door brackets are known in the art. However, these over the door brackets usually have vertical members that extend down the door and are generally flat. These flat members make it difficult to install and remove the over the door bracket without causing damage to the door because the edges may dig into the door and mar the surface or chip off paint. Further, the use of flat members makes it difficult to attach a clothing support member to the brackets without removing the bracket from the door because the bracket is flat against the door.

It is known to plate a bracket with a plating material such as chrome to make it less abrasive to surfaces with which the bracket will make contact, and to make the bracket more attractive. In most cases, the chrome plating is not be applied uniformly and the bracket will be subjected to a discontinuous coating, making the bracket susceptible to rust.

The present invention solves the problems of the prior art by providing an over the door bracket with a tubular vertical member that has oppositely facing tapered ends. The over the door bracket includes a drainage hole to ensure uniform application of the chrome during plating.

SUMMARY OF THE INVENTION

In accordance with the preferred embodiment of the present invention, an over the door bracket is provided for being hung on a door, the bracket having a top portion, a forward side adjacent the surface of the door, and a rearward side facing away from the door's surface. The bracket includes a door connecting member that is adapted to be hung on the top of the door. The bracket also includes a generally tubular member extending from the door connecting member. The generally tubular member has a frontward facing surface and a rearward facing surface. A first connecting end of the tubular member is connected to the door connecting member and a second connecting end is disposed at the opposite end of the tubular member. Clothing support attaching means is provided at the second connecting end for being to a clothing support member, such as a hook or knob holder provided for hanging clothing, hangers and other items.

The bracket preferably includes a generally inverted U-shaped member adapted to be placed over the door, having three sides which meet at right angles. The U-shaped member includes a generally flat middle portion having a length slightly larger than the thickness of a door with which the bracket will be used, a first generally flat portion extending transversely from one end of the middle portion, and a second generally flat portion extending transversely from the other end of the middle portion. The generally flat middle portion can be placed against the top of the door, the first generally flat portion can be placed against one side of the door, and the second generally flat portion can be placed against the opposite side of the door. A generally tubular member extends from the second generally flat portion. The generally tubular member has a frontward facing surface, and a rearward facing surface. The frontward facing surface is engagable with one side of the door when the U-shaped member is placed over the door. Clothing support attaching means is provided for securing a clothing support member to the bracket.

In another preferred aspect of the present invention, a clothing bracket system is provided for being attached to a door. The system includes at least two over the door brackets. The system can also include clothing support attachment means as described with the first embodiment.

An object of the invention is to provide an over the door bracket that is less likely to damage doors during installation and use than prior over the door brackets.

Another object of the invention is to provide an over the door bracket that is easy to attach and remove from a door.

Another object of the invention is to provide an over the door bracket that allows for easy installation and interchangeability of clothing support members.

Yet another object of the invention is an over the door bracket that can be uniformly coated with protective and attractive plating.

It is yet a further object of the invention to provide an over the door metal bracket that is resistant to rust.

It is a further object of the invention to provide a clothing bracket that is sturdy, easy to manufacture, install and remove having the foregoing stated objects.

These and other objects will become apparent from the following description of a preferred embodiment taken together with the accompanying drawings and the appended claims.

DESCRIPTION OF THE PREFERRED EMBODIMENT

Figure 3:
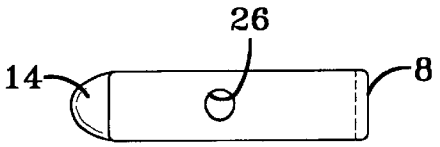
FIG. 3 is a top view of the door bracket of FIG. 1.
Figure 1:
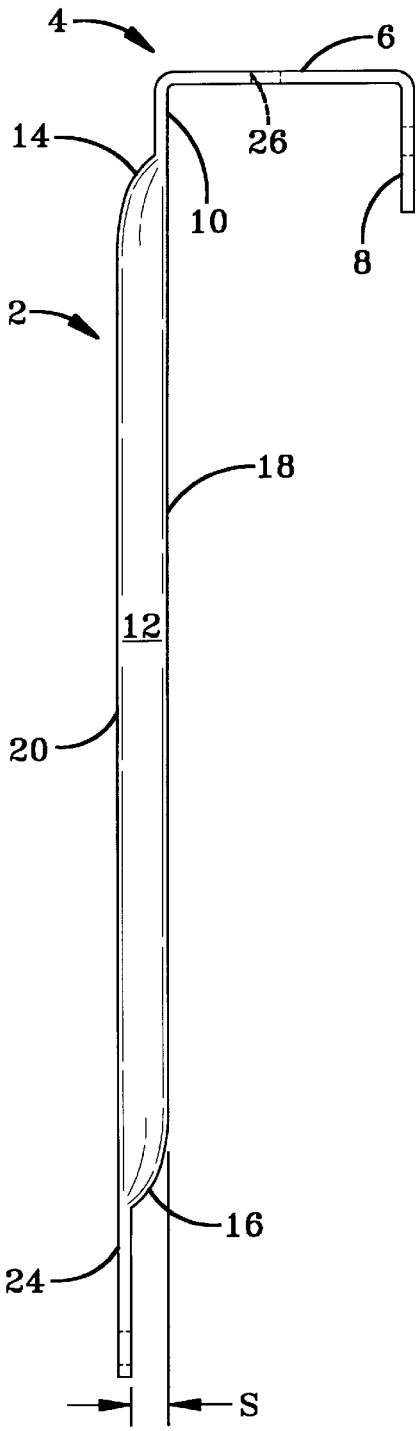
FIG. 1 is a side view of a preferred over the door bracket.
Figure 2:
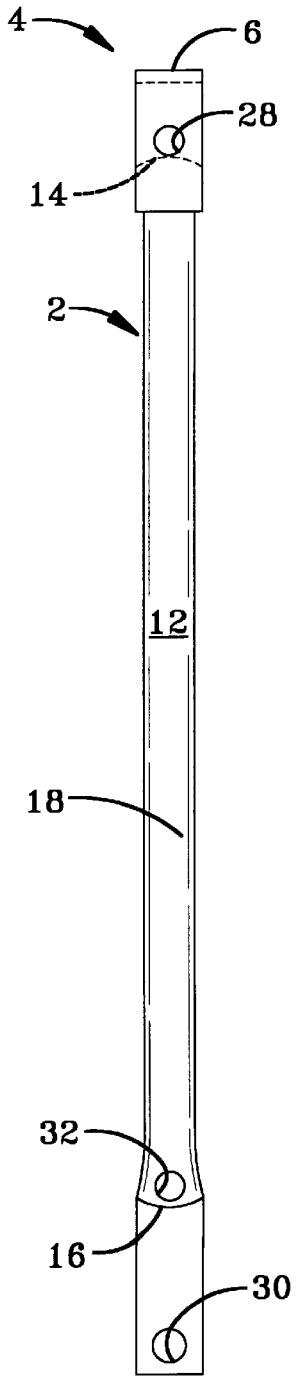
FIG. 2 is front view of the door bracket of FIG. 1.

Referring now to the drawings wherein the showings are for the purpose of illustrating the preferred embodiment of the invention only, and not for the purpose of limiting the same, FIGS. 1–3 show a preferred over the door bracket 2 having a generally U-shaped door connecting member 4. Generally U-shaped door connecting member 4 includes a generally flat middle portion 6, and two generally flat transverse portions 8 and 10, each extending generally perpendicularly from opposite ends of generally flat middle portion 6 and being generally oppositely disposed and parallel to each other. Portion 8 will be referred to as the first generally flat portion, and portion 10 will be referred to as the second generally flat portion. Connecting member 4 is adapted to be placed over the top of a door, such as in a closet or bedroom. The connecting member 4 includes apertures 26 and 28 for optionally receiving an attaching member such as a screw for securing bracket 2 to the door. The screws should be countersunk and holes 26 and 28 beveled so as not to increase the height or width of the door on which bracket 2 is mounted which could obstruct the door during opening and closing. Generally flat portion 6 will lie against the top of the door when connecting member 4 is placed over the door. Further, first and second generally flat portions 8 and 10 lie against the front and rear portions of the door, respectively, when connecting member 4 is placed over the door.

A tubular member 12 is an extension of second generally flat 10 portion tubular member or pipe 12 has a first connecting end 14 connected to second generally flat 10 portion, and a second connecting end 16 connected to a clothing support attaching member 24. Tubular member 12 has a frontward facing surface 18 and a rearward facing surface 20. Frontward facing surface 18 would be adjacent to the rear or front of the door when connecting member 4 is placed over the door. The rounded frontward facing surface 18 ensures that the door is not scratched to avoid marring of the door or chipping of any parts when the bracket is installed or removed. Importantly, the first connecting end 14 is tapered from the second generally flat portion 10 to its rearward facing surface 20. The second connecting end 16 is tapered from its frontward facing surface 18 toward the rearward facing surface 20. Clothing support attaching member 24 extends from the second connecting end 16, so there is a space between member 24 and rearward facing surface 18. This unique design allows for interchangeability of clothing support brackets without removing bracket 2 from the door. The unique design also makes it easier to remove the brackets from the door without scratching the door. Member 24 includes a hole 30 adapted to receive a conventional screw or other attaching member. The conventional screw is used in conjunction with a conventional nut to releasably secure different clothing supports to one or more door brackets 2.

Bracket 2 is preferably made from metal such as an appropriate steel to make the bracket sturdy. Bracket 2 is preferably chrome plated to aid in its ability to be scratch resistant to doors when being installed and removed, as well as to make it more attractive. It was found that by providing a drainage hole 32 in second connecting end 16, a virtually uniform coating of chrome plating could be applied to bracket 2. Hole 32 prevents the plating liquid from being trapped in door bracket 2, and therefor prevents the liquid from leaking out later. The plating liquid can easily drain out of tubular member 12. In addition, the inside of member 12 stays dry. Hence, bracket 2 was found to be extremely resistant to rusting.

Figure 4:
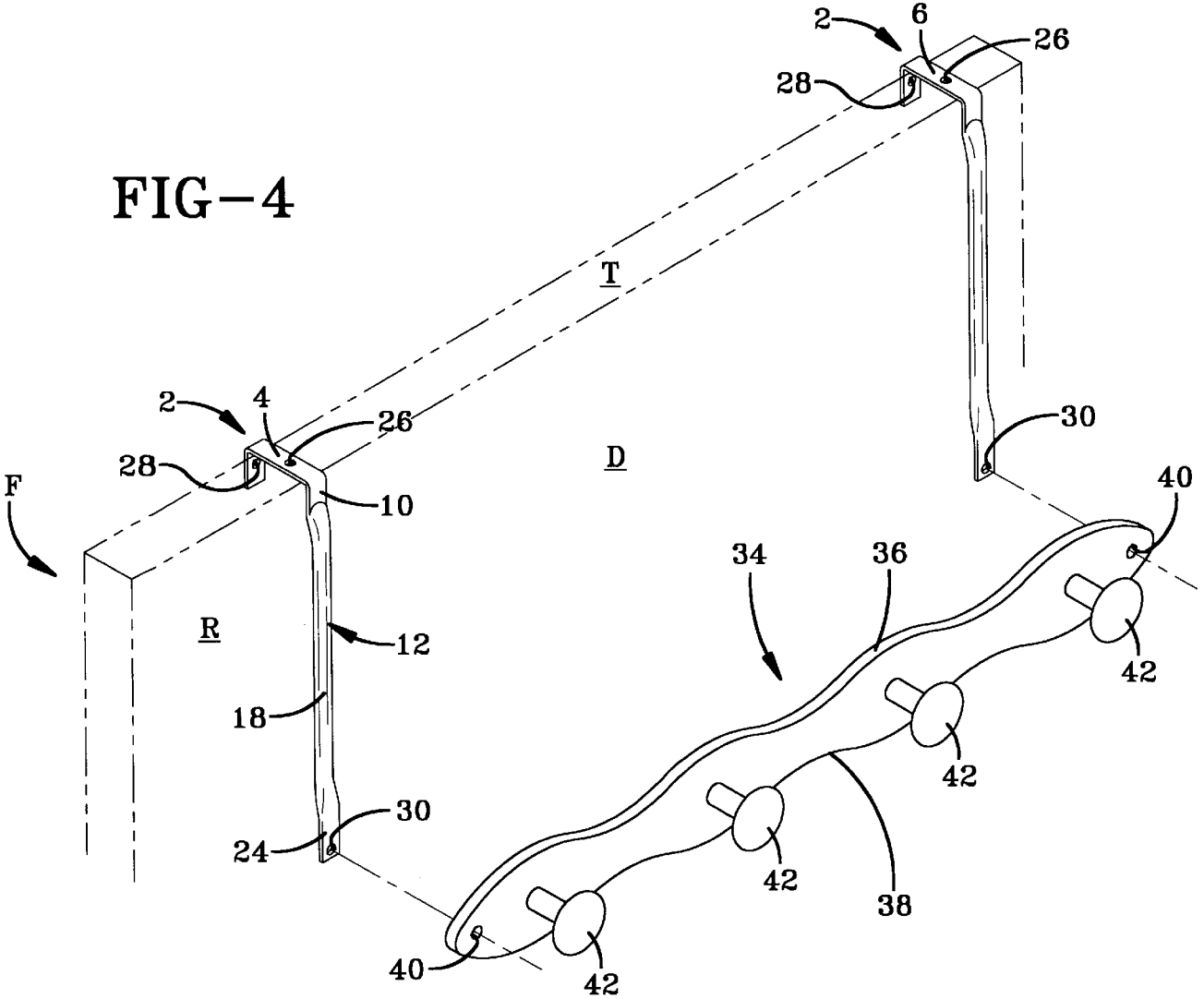
FIG. 4 is perspective view of a preferred clothes organizer system with a door shown in phantom lines.

FIG. 4 shows the use a pair of over the door brackets 2 used in a clothing storage system attached to a door D. Door D has a front surface F, a rear surface R and a top surface T. Door connecting members 4 are placed over the top surface T of door D with tubular member 12 running along rear surface R. Door brackets 2 are then affixed to the door by using conventional screws or fasteners via apertures 26 and 28. Once brackets 2 are fixed in place, a clothing support member 34 can be attached to clothes support attaching member 34 through holes 40 and 30 via a conventional screw or nut and bolt arrangement. In this particular embodiment, clothes support member 34 includes a top wave-like surface 36 and a bottom wave-like surface 38. This shape not only makes it easier to hold during the attachment supporting member 34 to brackets 2, but also provides an aesthetically pleasing clothing support member. Clothing support member 34 also includes a plurality of knobs 42 for hanging clothes or other articles of this type.

Knobs 42 could be replaced by other storage devices such as hooks, clips, resilient arms or the like. Although the apparatus has been described for hanging clothing, it could be adopted for storing many other types of articles, such as tools.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

What is claimed is:

1. An over the door bracket for being hung on a door, the door having a top portion, a first side and a second side, said bracket comprising:

a door connecting member for being placed over the top of the door;

a generally tubular member extending from said door connecting member, said generally tubular member having a frontward facing surface and a rearward facing surface, and a first connecting end connected to said door connecting member and a second connecting end opposite the first connecting end, said frontward facing surface placeable adjacent one side of the door when said door connecting member is placed over the top of the door, wherein said first connecting end is tapered forwardly from the rearward facing surface toward the frontward facing surface of said tubular member and said second connecting end is tapered rearwardly from the frontward facing surface of said tubular member toward the rearward facing surface; and a clothing support attaching member for attachment to said tubular member for securing a clothing support to said bracket.

2. The over the door bracket of claim 1, wherein said bracket is chrome plated.

3. The over the door bracket of claim 2, and further comprising a drainage hole disposed near the second connecting end of said tubular member.

4. The over the door bracket of claim 1, wherein said clothing support attaching member comprises a generally flat portion extending from said second connecting end of said tubular member, said generally flat portion including an attachment member for attaching a clothing support to said bracket.

5. The over the door bracket according to claim 4 wherein said attachment member is a hole for receiving an attaching member.

6. The over the door bracket of claim 1, wherein said door connecting member is an inverted U-shaped member adapted to be placed over the door.

7. The over the door bracket of claim 6, wherein said inverted U-shaped member comprises a generally flat middle portion, and two generally transverse portions extending from opposite ends of said middle portion and being opposite and parallel to each other.

8. The over the door bracket of claim 7 wherein said first connecting end of said tubular member is integral with one of said two generally transverse portions of said inverted U-shaped member.

9. The over the door bracket of claim 7, wherein said bracket is chrome plated.

10. The over the door bracket of claim 9, and further comprising a drainage hole disposed near the second connecting end of said tubular member.

11. The over the door bracket according to claim 1 wherein said door connecting device has at least one hole for receiving an attaching device for attaching the bracket to the door.

12. An over the door bracket for being hung on a door, the door having a top, a first side and a second side, said bracket comprising:

an inverted generally U-shaped member adapted to be placed over the door, said inverted U-shaped member having a generally flat middle portion for lying flat against the top of the door with a first end and a second end, a first generally flat portion extending transversely from said first end and a second generally flat portion being generally parallel to and being disposed opposite to each other, wherein said first generally flat portion being adjacent to the first side of the door and said second generally flat portion being adjacent to the second side of the door when said inverted U-shaped member is hung over the door;

a generally tubular member extending from said second generally flat portion, said generally tubular member having a frontward facing surface, and a rearward facing surface, and a first connecting end connected to said first generally flat portion and a second connecting end at the opposite end of said tubular member, said frontward facing surface being adjacent to the second side of the door when said U-shaped member is hung over the door, and wherein said second connecting end is tapered rearwardly from the frontward facing surface toward the rearward facing surface of said tubular member, leaving a space between said frontward facing surface and said rearward facing surface of said tubular member; and a clothing support attaching member for attachment to said tubular member for attaching a clothing support to said bracket.

13. The over the door bracket of claim 12, wherein said clothing support attaching member comprises a generally flat portion extending from the second connecting end of said tubular member, and being parallel to said second generally flat portion.

14. The over the door bracket of claim 12, wherein said first connecting end is tapered rearwardly from said second generally flat portion towards said rearward facing surface of said tubular member.

15. The over the door bracket of claim 12, and further including securing means for securing the inverted U-shaped member to the door.

16. A clothing storage system for being hung on a door, the door having a top, a first side and a second side, said system comprising:

at least two over the door brackets, each bracket comprising:

a door connecting member for being placed over the top of the door; and a generally tubular member extending from said door connecting member, said generally tubular member having a frontward facing surface and a rearward facing surface, and a first connecting end connected to said door connecting member and a second connecting end at the opposite end of said first connecting end, said frontward facing surface being adjacent to the second side of the door when said door connecting member is hung over the door, wherein said first connecting end is tapered rearwardly and is adjacent to the door, and said second connecting end is tapered rearwardly from the frontward facing surface to the rearward facing surface of said tubular member, to leave a space between the frontward facing surface and the rearward facing surface;

a clothing supporting member for supporting various articles of clothing; and a clothing support attaching member attached to said second connecting end of said brackets for securing said clothing supporting member to said brackets, said clothing support attaching member being spaced from the door when said brackets are hung on the door, said clothing supporting member including at least one holding member for holding clothing.

17. The clothing storage system of claim 16, and each bracket further comprising a drainage hole disposed near the second connecting end of said tubular member.

18. The over the door bracket of claim 16, wherein said clothing support attaching member comprises a generally flat portion extending from the second connecting end of said tubular member, said generally flat portion including a screw hole extending therethrough.

19. The clothing storage system of claim 16, wherein at least one of said brackets is chrome plated and includes a drainage hole disposed near the second connecting end of said tubular member.

* * * * *